United States Patent [19]

Kobayashi et al.

[11] Patent Number: 4,593,499

[45] Date of Patent: Jun. 10, 1986

[54] INTERIOR PANEL

[75] Inventors: Hiroshi Kobayashi, Tokyo; Toshio Yasunaga; Toshihiko Muro, both of Yokohama; Fumio Takeda, Terada; Yutaka Tsuruta, Funabashi, all of Japan

[73] Assignees: Kabushiki Kaisha Toshiba, Kawasaki; Taisei Corporation, Tokyo, both of Japan

[21] Appl. No.: 674,086

[22] Filed: Nov. 23, 1984

[30] Foreign Application Priority Data

Nov. 24, 1983 [JP] Japan ..... 58-220988

[51] Int. Cl.[4] ..... E04B 5/58; E04B 5/48

[52] U.S. Cl. ..... 52/126.6; 52/220

[58] Field of Search ..... 52/126.1, 126.2, 126.6, 52/220, 221, 98, 99, 100

[56] References Cited

U.S. PATENT DOCUMENTS 2,867,301 1/1959 Benton ..... 52/220
4,258,516 3/1981 Mori et al. ..... 52/126.6

FOREIGN PATENT DOCUMENTS 1306680 9/1962 France ..... 52/126.6
1475402 3/1967 France ..... 52/126.6
1335829 10/1973 United Kingdom ..... 52/126.6

*Primary Examiner*—Henry E. Raduazo
*Assistant Examiner*—John Malcolm White
*Attorney, Agent, or Firm*—Oblon, Fisher, Spivak, McClelland & Maier

[57] ABSTRACT

An interior panel according to the present invention comprises a plurality of support units fixedly arranged on a floor slab, a panel member supported by the support units so as to be located over the slab surface at a predetermined distance therefrom, and a cable separator supported by the support units and dividing the space between the panel member and the slab surface into upper and lower space sections. The cable separator is in the form of a plate with a stepped surface portion at the peripheral edge portion thereof, and can be supported on the support units either in a first position in which the stepped portion faces upward or in a second position in which the stepped portion faces downward. Cables and electric devices in a signal transmission system are arranged in the upper space section defined by the cable separator, and power supply-system cables and devices in the lower space section.

14 Claims, 5 Drawing Figures

INTERIOR PANEL

BACKGROUND OF THE INVENTION

The present invention relates to interior panels adapted to be spread over the floor, foundation, or slab of an office room or computer room to form the room floor and, more specifically, to interior panels permitting an arrangement of power cables, signal transmission cables, and electric devices between the room floor and the slab.

With the progress of microelectronics, office rooms have recently come to be furnished with a number of office-automation apparatuses. Presently, moreover, what is called a local area network is being developed which connects these office-automation apparatuses. The local area network is a system for high-speed data communications of, e.g., 10 Mbit/sec between a plurality of work stations, a large-capacity filing system, and a large-capacity printing system. In order to form such a local area network, therefore, it is necessary to connect the work stations and the large-capacity filing and printing systems by means of signal transmission cables such as coaxial cables or optical fiber cables. Also, the office-automation apparatuses need to be connected with power cables for electric power supply. Accordingly, in an office room provided with the local area network, as in a conventional computer room, the signal transmission cables and power cables are stretched in all directions around the space between the office floor and the floor slab, and couplers, transceivers, modems and other electric devices connecting the signal transmission cables and the individual office-automation apparatuses, along with electric devices connected to the power cables, are arranged in accordance with the layout of the apparatuses.

In laying the signal transmission cables and power cables in an office room, they are legally required to avoid contact with one another. It is, therefore, very difficult to properly arrange the signal transmission cables and power cables in offices with the local area network.

In the offices, moreover, there may frequently arise the need for changing the layout of office-automation apparatuses or installing addition office-automation apparatuses. In this case, rearrangement of the signal transmission cables and power cables would conventionally require large-scale construction job, rendering the layout of the office-automation apparatuses less readily adaptable.

SUMMARY OF THE INVENTION

The object of the present invention is to provide an interior panel permitting a safe and easy arrangement of signal transmission cables, power cables, and various electric devices in an office or computer room and which is capable of readily coping with a layout change of the apparatuses installed in the room.

An interior panel according to the present invention overlies the surface of a slab such as a floor, wall or ceiling slab defining the inside space of a room to form the interior surface of the room so that a space permitting the installation of signal transmission cables, power cables, and electric devices can be secured between the interior panel and the slab surface.

This interior panel comprises a plurality of support means fixedly arranged on the slab surface, the support means each including a first supporting portion and a second supporting portion positioned at predetermined distances from the slab surface, a panel member supported on the respective first supporting portions of the support means at a predetermined distance from the slab surface so that the distance between the inside face of the panel member and the second supporting portion of the support means is substantially equal to that between the second supporting portion of the support means and the slab surface, and a cable separator interposed between the panel member and the slab surface, the cable separator having the form of a plate with a stepped surface portion at the peripheral edge portion thereof supported on the second supporting portion of the support means, whereby the space between the panel member and the slab surface is divided into a first space defined between the panel member and the cable separator for the arrangement of the signal transmission cables and electric devices connected thereto and a second space defined between the cable separator and the slab surface for the arrangement of the power cables and electric devices connected thereto.

According to the present invention, the signal transmission cables in the first space and the power cables in the second space are separated by the cable separator, so that they can securely be prevented from coming into contact with one another. In arranging these cables, the power cables are first laid on the slab surface, and then the second space for the arrangement of the power cables is defined by means of the cable separator. Thereafter, the signal transmission cables are laid on the cable separator. Thus, the signal transmission cables can be laid irrespectively of the arrangement of the power cables, that is, the construction of these cables is easy.

According to the present invention, moreover, the cable separator has the form of a plate with a stepped surface portion at its peripheral edge portion, and is set so that the stepped portion is supported by the respective second supporting portions of the support means which are located substantially halfway between the inside face of the panel member and the slab surface. Thus, the cable separator can be supported on the second supporting portions either in a first position in which the stepped surface portion faces upward or in a second position in which the stepped surface portion faces downward. If the cable separator is supported in the first position, the first space is wide enough to easily contain the signal-system devices. If the cable separator is supported in the second position, the second space is wide enough to easily contain the electric-system devices. In this case, moreover, the wider second space can also contain surplus portions of the power cables. Thus, according to the interior panel of the present invention, the signal transmission cables, power cables, and various electric devices can easily be arranged by changing the mounting position of the cable separator in accordance with the layout of the cables and devices.

DETAILED DESCRIPTION OF THE PREFERRED EMBODIMENTS

Figure 1:
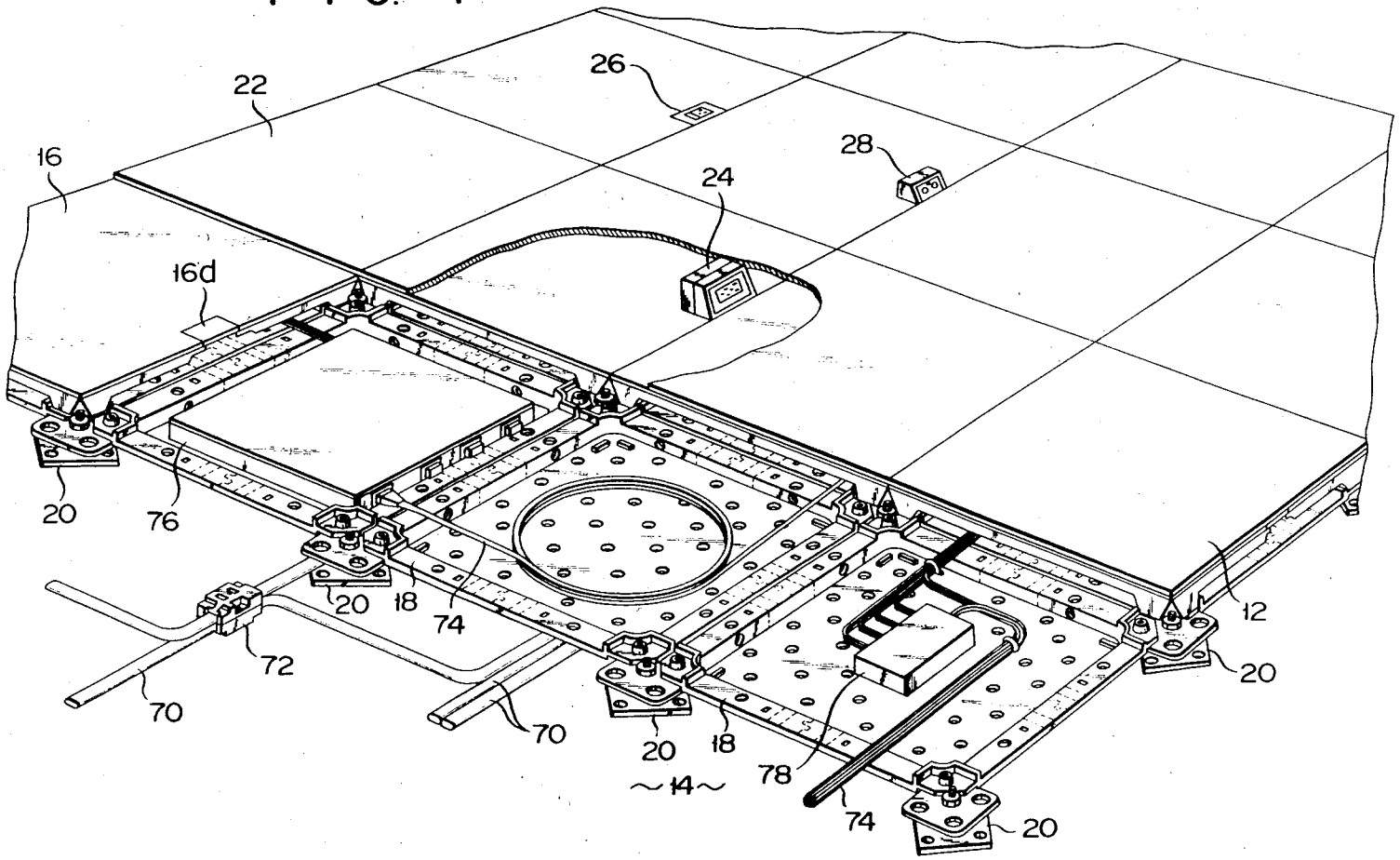
FIG. 1 is a perspective view of a plurality of floor panels according to a first embodiment of the present invention, furnished with signal transmission cables and power cables, and spread over a floor slab.

Referring now to FIG. 1, there are shown floor panels 12 as a specific example of interior panels according to a first embodiment of the present invention. The floor panels 12 are spread over a floor slab 14 of an office, forming the office floor.

Figure 2:
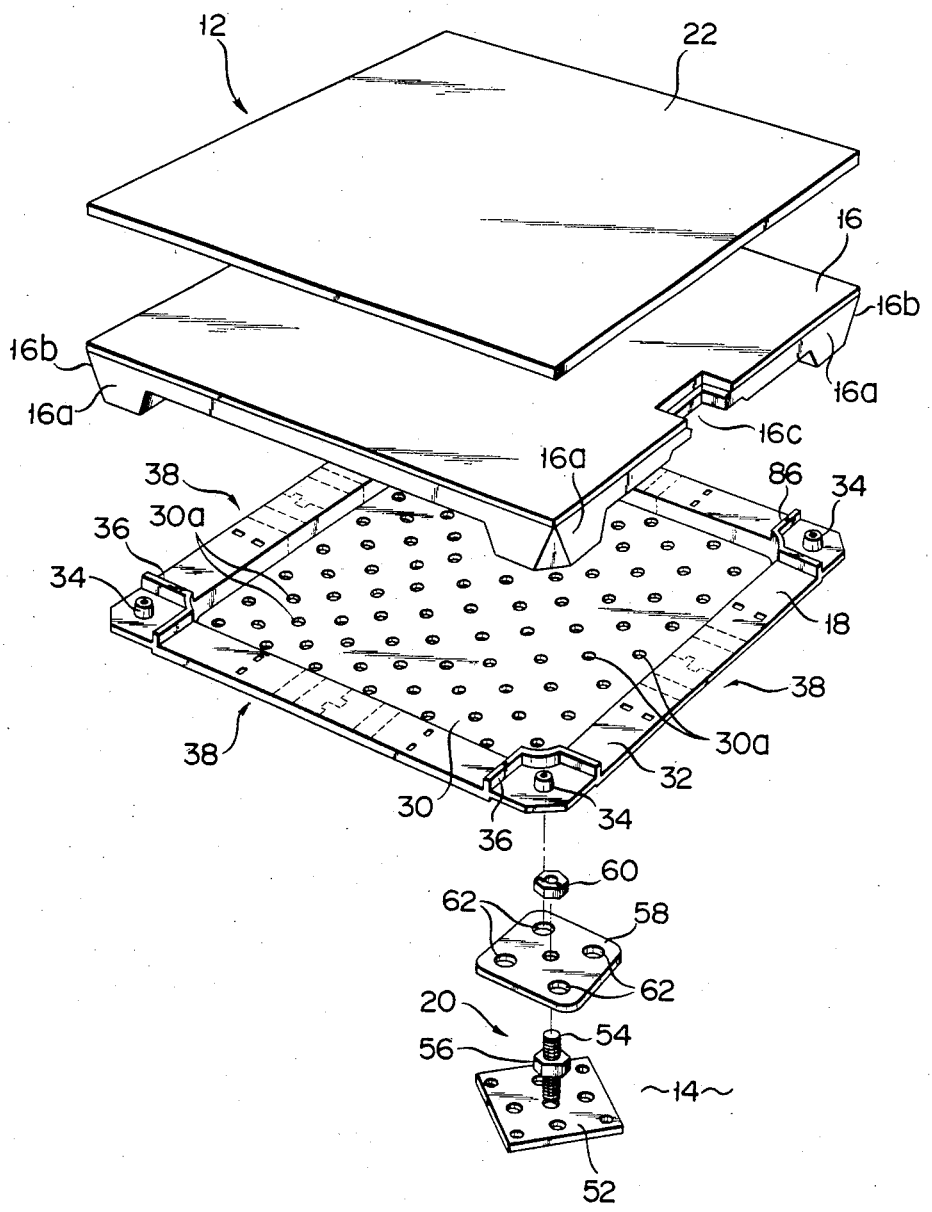
FIG. 2 is an exploded view of one of the floor panels shown in FIG. 1.

As shown in detail in FIG. 2, each floor panel 12 includes as its main components a panel member 16, a cable separator 18, and a plurality of support units 20. The panel member 16 is formed in the shape of a square of, e.g., 50 cm×50 cm for the ease of construction work and transport. The panel member 16 is made of, e.g., glass-reinforced cement. Four leg portions 16*a* protrude downward from the four corners of the lower surface of the panel member 16, individually. A bevel 16*b* is formed on each leg portion 16*a* of the panel member 16 so that the respective bevels 16*a* of each two diagonally adjoining panel members 16 face each other in the state of FIG. 1 in which the floor panels 12 are spread over the floor slab 14. A blind hole (not shown) is formed in the bottom surface of each leg portion 16*a* of the panel member 16.

A rectangular indentation 16*c* is formed in one side of the panel member 16. The indentation 16*c* is utilized for leading out signal transmission cables or power cables (mentioned in detail later) onto the floor. An outlet box 24, a floor outlet 26, or a cable fitting 28 can be fitted in the indentation 16*c*. Thus, these connection device are connected to a signal transmission cable or a power cable. If unnecessary, the indentation 16*c* can be filled up with a blank piece 16*d*, as shown in FIG. 1. The blank piece 16*d* is formed of the same material as the panel member 16.

In the case of the first embodiment, the floor panel 12 is provided with a surface member 22 pasted on the surface of the panel member 16. The surface member 22, which has the same square shape and the same size as the panel member 16, is formed from a conventional flooring material such as vinyl tiles or carpeting, depending on the application of the office room. If the outlet box 24, the floor outlet 26, or the cable fitting 28 is fitted in the indentation 16*c* of the panel member 16, that portion of the surface member 22 corresponding to the indentation 16*c* is to be cut off.

The cable separator 18 is formed from an electric insulating material, such as polypropylene, polyvinyl chloride or asbestos. In this case, polypropylene is adapted for the use because of its transparency and good strength. The cable separator 18 is formed of a substantially square plate similar to the panel member 16, and has a square depression 30 in the center. Thus, the peripheral edge portion of the cable separator 18 constitutes a stepped portion 32 which projects upward from the depression 30. Substantially conical upper and lower projections 34 protrude upward and downward from the four corner portions of the stepped portion 32 of the cable separator 18, individually. The upper projections 34 of the stepped portion 32 are adapted to be fitted in the blind holes in the bottom surface of the leg portions 16*a* of the panel member 16 when the cable separator 18 and the panel member 16 are joined together. Partition walls 36 are formed individually on the four corner portions of the upper surface of the stepped portion 32 so as to surround their corresponding projections 34 from two directions.

Bend portions 38 are formed individually at the respective central portions of the four sides of the stepped portion 32 of the cable separator 18. In each of the bend portions 38, part of the level surface portion 32*a* and/or the vertical surface portion 32*b* of the stepped portion 32 can be bent. For example, the bend portion 38 is defined by cut lines and bend lines in the stepped portion 32, which can be formed cutting V-shaped grooves in the stepped portion 32. The cut lines may alternatively be formed of perforated lines instead of the bend lines. It is necessary only that the cut lines of the stepped portion 32 be able to facilitate the cutting at the stepped portion 32 with use of a knife, nipper or other tool.

A number of holes 30*a* are bored in the form of a matrix through the depression 30 of the cable separator 18. The holes 30*a* are used in rigidly mounting the signal transmission cables or electric devices connected thereto on the depression 30.

The support unit 20 will now be described in detail. The support unit 20 is provided with a pedestal 52 which is formed of a metal plate. A bolt 54 protrudes from the central portion of the pedestal 52. A first nut 56, a metallic flange plate 58, and a second nut 60 can be successively screwed on the bolt 54 of the pedestal 52. A tapped hole mating with the bolt 54 is bored through the central portion of the flange plate 58. The flange plate 58 is square, and four holes 62 capable of receiving the projections 34 of the cable separator 18 are bored individually through the four corner portions of the flange plate 58.

The floor panels 12 with the above-mentioned construction are spread all over the floor slab 14 of the office room in the following manner. First, the support units 20 are arranged at regular intervals to form a matrix on the floor slab 14, as shown in FIG. 1. In doing this, the support units 20 are fixed so that their pedestals 52 are in contact with the floor slab 14. At this time, the respective flange plates 58 of the support units 20 are leveled by adjusting the positions of the nuts 56 and 60. Here it is to be noted that the distance between the flange plate 58 and the slab surface is substantially equal to that between the inside face 16*e* of the panel member 16 and the bottom surface of each leg portion 16*a* of the panel member 16.

Thereafter, power cables 70 for supplying electric power to office-automation apparatuses to be installed in the office are arranged on the floor slab 14 in accordance with the layout of the apparatuses. In laying the power cables 70, branchers or other electric devices 72 in a power supplying system connected to the power cables 70 are arranged mainly on those lines which connect the support units 20, as shown in FIG. 1.

After the arrangement of the power cables 70 is finished, the cable separators 18 are each put in a division defined by each four adjacent support units 20 so that the stepped portions 32 of the cable separators 18 face upward, as shown in FIG. 1. Thus, the cable separators 18 are spread over the floor slab 14, leaving a suitable space between them. In doing this, the lower projections 34 at the four corners of each cable separator 18 are each fitted in one of the four holes 62 in the four corner portions of the flange plate 58 of each of their corresponding four support units 20. Thus, the cable separators 18 are supported by four support units 20 each. As seen from FIG. 1, the remaining three holes 62 of the flange plate 58 of each support unit 20 are used for receiving the lower projections 34 of the adjoining cable separators 18.

Each of the electric devices 72 in the power supplying system is located under the adjoining sides of the respective stepped portions 32 of two adjacent cable separators 18. Accordingly, the appropriate distance between the floor slab 14 and the cable separators 18 in the region for the electric device 72 is maintained by the pair of stepped portions 32. Thus, the cable separators 18 constitute no hindrance to the arrangement of the electric devices 72 in the power supplying system.

After the cable separators 18 are arranged in this manner, they are fitted with signal transmission cables 74, including coaxial cables, optical fiber cables, and telephone lines, which are connected to the office-automation apparatuses to be installed in the office in accordance with the layout of the apparatuses. While the signal transmission cables 74 are being laid, the cable separators 18 are fixedly mounted with couplers, transceivers, modems or other electric devices 76 in a signal transmission system or telephone terminal 78. As shown in FIG. 1, spare signal transmission cables 74 are also kept in the depressions 30 of some of the cable separators 18. The electric devices 76, the telephone terminals 78, and the spare signal transmission cables 74 are fixed by the use of fixing means (not shown) which are attached to the holes 30*a* in the depressions 30 of the cable separators 18.

In taking out the power cables 70 over the floor slab 14 onto the cable separator 18 or the floor, one of the bend portions 38 of the stepped portion 32 of the cable separator 18 is bent to form an opening which connects the spaces above and below the cable separator 18 so that the power cables 70 are passed through the opening.

After the power cables 70 and the signal transmission cables 74 to be led onto the office floor are arranged in this manner, the panel members 16 are put individually on the cable separators 18 to form the office floor. At the same time, the upper projections 34 at the four corners of each cable separator 18 are fitted individually in the blind holes in the bottom surfaces of the four corner leg portions 16*a* of each corresponding panel member 16. Thus, the panel members 16 are supported on the support units 20 through the medium of the cable separators 18.

Here it is to be noted that, in this embodiment, the respective flange plates 58 of the support units 20 serve as supporting means for both the cable separator 18 and the panel member 16. Since the partition wall 36 is formed at each corner portion of the cable separator 18, the signal transmission cables 74 on the cable separator 18 will never be shifted to the side of the projections 34 after arrangement. Thus, in mounting the panel member 16 on the cable separator 18, the signal transmission cables 74 can securely be prevented from being crushed by the leg portions 16*a* of the panel member 16.

The power cables 70 to be led onto the office floor may be connected to the outlet boxes 24 or the floor outlets 26 fitted in the indentations 16*c* of their corresponding panel members 16, or may be taken out onto the floor through the cable fittings 28 also fitted in the indentations 16*c* of their corresponding panel members 16. Likewise, the signal transmission cables 74 are led onto the office floor through the cable fittings 28 in the indentations 16*c* of their corresponding panel members 16.

Thereafter, the surface members 22 such as carpeting are pasted on the spread panel members 16 to complete the office floor.

After this is done, moreover, the office-automation apparatuses are set on the office room floor in accordance with their predetermined layout, and the power cables 70 and the signal transmission cables 74 are connected to these apparatuses.

According to the floor panels 12 of this embodiment, as described above, the signal transmission cables 74 are arranged in a first space defined between the panel members 16 and the cable separators 18, and the power cables 70 in a second space between the cable separators 18 and the floor slab 14. Accordingly, the power cables 70 and the signal transmission cables 74 can assuredly be isolated from one another by the cable separators 18. Thus, in laying the power cables 70 or the signal transmission cables 74, they can be arranged irrespectively of the arrangement of their matches, facilitating the construction work.

Since each cable separator 18 has the depression 30 and the stepped portion 32, the signal-system device 76 or the like may fully be housed in the depression 30, and the brancher or other power supplying system device 72 may be interposed between the floor slab 14 and the stepped portion 32.

Figure 3:
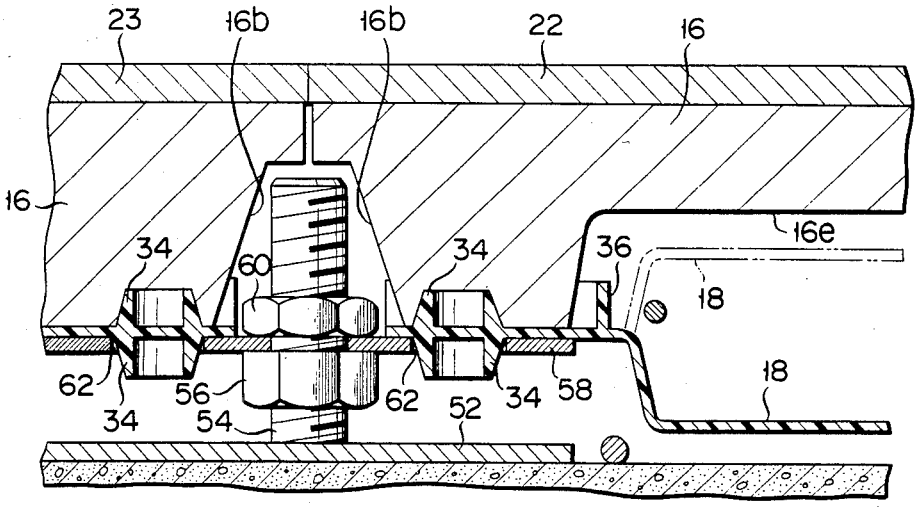
FIG. 3 is a partial sectional view showing two adjacent floor panels.

Thus, with the floor panel 12 of the present invention, the space between the panel member 16 and the floor slab 14, including the aforesaid first and second spaces, can effectively be utilized for installing electric devices of the power supplying and signal transmission systems. This leads to a reduction of the overall thickness of the floor panel 12. Moreover, the flange plate 58 of each support unit 20 is positioned so that the distance between the inside face 16*e* of the panel member 16 and the flange plate 58 is substantially equal to that between the flange plate 58 and the slab surface. Therefore, the cable separator 18 can be arranged inside out as required, as is represented by an imaginary line in FIG. 3. The second space can be made wider than in the case of the first embodiment by thus turning over the cable separator 18 so that its stepped portion 32 faces downward. With this arrangement, the second space can collectively contain therein surplus portions of the power cables 70 or a large electrical device, if necessary. In other words, the first and second spaces of the floor panel 12 of the invention can more effectively be utilized for the installation of various electric devices, so that the overall thickness of the floor panel 12 can further be reduced.

In the case of the floor panel 12 of the present invention, moreover, the panel member 16 and the cable separator 18 are removably mounted on the support units 20, and the cable separator 18 can be arranged inside out. If any of the office-automation apparatuses previously installed in the office room requires a change of layout, therefore, the panel member 16 and/or the cable separator 18 may be removed for rearrangement of the signal transmission cables 74, the power cables 70, and/or the electric devices. In accordance with this rearrangement, the mounting position of the cable separator 18 can be changed. Since the cable separators 18 are formed of transparent polypropylene, the power cables 70 can be visually checked for arrangement with ease through the cable separators 18. Also from this point of view, the floor panel 12 of the invention is adapted for use as a free-access floor panel which can readily cope with a change of layout of office-automation apparatuses.

Figure 4:
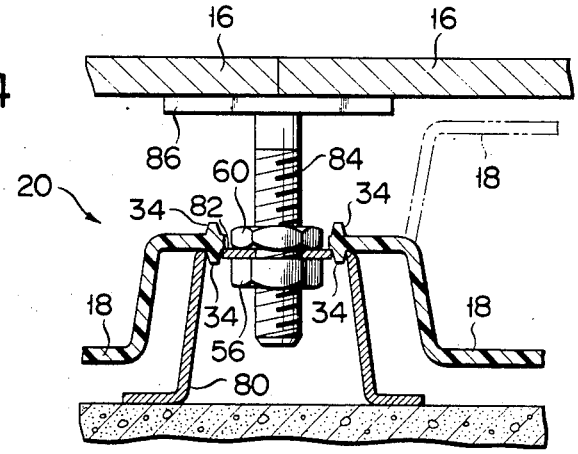
FIGS. 4 and 5 are sectional views showing different modifications of the floor panels of the invention.
Figure 5:
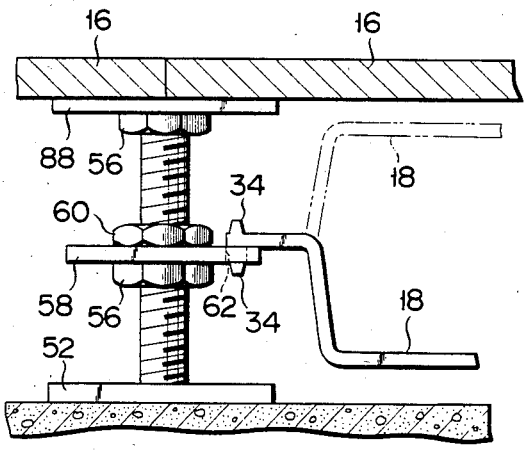

The present invention is not limited to the floor panel 12 of the first embodiment described above. Referring now to FIGS. 4 and 5, there are shown different modifications of the floor panel 12. A support unit shown in FIG. 4 is provided with a cup-shaped metallic pedestal 80. The top wall of the pedestal 80 is defined by a bearing surface 82 of the cable separator 18 which has the same function as the flange plate 58. A bolt 84 is vertically screwed in the central portion of the pedestal 80. A supporting plate 86 for supporting the panel member 16 is mounted on the upper end of the bolt 84. With use of the support unit 20 shown in FIG. 4, it is possible to secure a space wide enough to allow the reversal of the cable separator 18 between the inside face 16*e* of the panel member 16 and the slab surface without providing leg portions at the four corners of the panel member 16. In this case, the distance between the supporting plate 86 and the bearing surface 82 of the pedestal 80 is substantially equal to that between the bearing surface 82 of the pedestal 80 and the slab surface.

A support unit 20 shown in FIG. 5, like the one shown in FIG. 4, is provided with supporting plates for supporting the cable separator 18 and the panel member 16, individually. In the support unit 20 of FIG. 5, a supporting plate 88 for supporting the panel member 16 is mounted on the upper end portion of a bolt similar to that of the support unit shown in FIG. 2.

In FIGS. 4 and 5, like reference numerals are used to designate like members.

Although the interior panels according to the first embodiment of the present invention are applied to floor panels, as described above, it is to be understood that the invention may also be applied to ceiling panels or wall panels.

What is claimed is:

1. An interior panel which overlies the surface of a slab defining the inside space of a room to form the interior surface of the room so that a space to permit installation of signal transmission cables, power cables, and electric devices is formed between the interior panel and the slab surface, comprising:

a panel member;

a cable separator; and a plurality of support means fixedly arranged on the slab surface, said support means supporting the panel member at a predetermined distance from the slab surface and supporting the cable separator interposed between the panel member and the slab surface, each said support means comprising a supporting portion contactingly supporting said cable separator and disposed such that the distance between the inside face of the panel member and the supporting portion is substantially equal to the distance between the supporting portion and the slab, the cable seaparator having the form of a plate dividing the space between the panel member and the slab into a first space between the panel member and the cable separator and a second space between the cable separator and the slab, the cable separator having a stepped surface at the peripheral edge portion, the support means supporting the cable separator by contact between the supporting portion and the stepped surface, said supporting portion and said stepped surface being configured for removal of the cable separator, inversion and replacement thereof, and continued support of said stepped surface by said supporting portion following said inversion and replacement.

2. An interior panel as claimed in claim 1, wherein the slab is visible through the cable separator.

3. An interior panel as claimed in claim 2, wherein the cable separator is transparent.

4. An interior panel as claimed in claim 3, wherein the cable separator is made of an electrically insulating material.

5. An interior panel as claimed in claim 4, wherein a plurality of holes are formed in said cable separator.

6. The interior panel according to claim 1, wherein both the panel member and the cable separator are square.

7. The interior panel according to claim 4, wherein each support means includes a plate-like pedestal fixed on the slab surface, a bolt portion set up on the pedestal, a first supporting plate screwed on the end of the bolt portion to support each corresponding corner portion of the panel member, and a second supporting plate screwed on the central portion of the bolt portion to support each corresponding corner portion of the cable separator, said supporting portion comprising said second supporting plate.

8. The interior panel according to claim 6, wherein each support means includes a cup-shaped pedestal fixed on the slab surface and having a top wall for supporting each corresponding corner portion of the cable separator, a bolt portion vertically screwed in the central portion of the top wall of the pedestal, and a supporting plate mounted on the end of the bolt portion to support each corresponding corner portion of the panel member, said supporting portion comprising said top wall of said cup-shaped pedestal.

9. The interior panel according to claim 6, wherein the panel member is further provided with an indentation formed in one side portion thereof so as to connect with the first space and adapted, if necessary, to hold therein a floor outlet, an outlet box, or a cable fitting, and, if unnecessary, to be filled up with a block piece.

10. The interior panel according to claim 1, wherein both the panel member and the cable separator are square, and leg portions extend downward from the four corners of the panel member, individually.

11. The interior panel according to claim 10, wherein each support means includes a plate-like pedestal fixed on the slab surface, a bolt portion set up on the pedestal, and a supporting plate screwed on the bolt portion to support both of each corresponding leg portion of the panel member and each corresponding corner portion of the cable separator, said supporting portion comprising said supporting plate.

12. The interior panel according to claim 11, wherein each corner portion of the cable separator and its corresponding leg portion of the panel member are supported in layers on the supporting plate.

13. The interior panel according to claim 12, wherein the supporting plate of each support means has four engaging holes formed in the peripheral edge portion thereof, the cable separator has lower projections protruding downward from the four corner portions thereof and adapted to be separately fitted in one of the engaging holes of each corresponding supporting plate and upper projections protruding upward from the four corner portions of the cable separator, and each leg portion of the panel member has a blind hole in the bottom surface thereof adapted to receive the upper projection of its corresponding corner portion of the cable separator.

14. The interior panel according to claim 13, wherein a partition wall is formed at each corner portion of the cable separator so as to surround one of the projections at the corner portion from the inside.

* * * * *